US006259885B1

(12) United States Patent
Ohkubo et al.

(10) Patent No.: US 6,259,885 B1
(45) Date of Patent: Jul. 10, 2001

(54) IMAGE FORMING APPARATUS HAVING TRANSPORTATION GUIDE WITH FLUORINATED RESIN

(75) Inventors: Masaharu Ohkubo, Yokohama; Hiroshi Kataoka, Susono, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/140,678

(22) Filed: Aug. 26, 1998

(30) Foreign Application Priority Data

Aug. 29, 1997 (JP) ..... 9-247606
Aug. 24, 1998 (JP) ..... 10-253239

(51) Int. Cl.[7] ..... G03G 15/00
(52) U.S. Cl. ..... 399/388
(58) Field of Search ..... 399/98, 316, 324, 399/328, 361, 381, 388, 394, 397, 400

(56) References Cited

U.S. PATENT DOCUMENTS 4,719,489 1/1988 Ohkubo et al. .
4,933,723 * 6/1990 Kakuta et al. ..... 399/316
4,937,600 6/1990 Hirabayashi et al. .
5,038,228 * 8/1991 Takada ..... 399/388 X
5,045,892 * 9/1991 Morisawa et al. ..... 399/400
5,268,724 * 12/1993 Koizumi et al. ..... 399/388 X
5,379,099 * 1/1995 Senba et al. ..... 399/324
5,594,539 * 1/1997 Murano et al. ..... 399/316
5,623,716 * 4/1997 Masaki et al. ..... 399/381 X
5,682,576 10/1997 Sakai et al. ..... 399/69

FOREIGN PATENT DOCUMENTS 7-120993 5/1995 (JP) .

* cited by examiner

*Primary Examiner*—Sandra Brase
(74) *Attorney, Agent, or Firm*—Fitzpatrick, Cella, Harper & Scinto

(57) ABSTRACT

An image forming apparatus is capable of maintaining a low charged potential on the surface of the guide member, thereby electrostatically preventing generation of paper dust. The image forming apparatus comprises a guide member for guiding the recording material and a rotary member for forming an image on the recording material guided by the guide member, wherein the guide member is composed of a conductive member having a layer of fluorinated resin on a guide surface for guiding the recording material. The fluorinated resin on the guide member is formed by coating and curing fluorinated resin on the conductive member. The guide member serves to change the transported direction of the recording material from the vertical direction to the horizontal direction. Such configuration prevents elevation of the potential on the fluorinated resin, covering the guide member, by friction with the recording material, thereby avoiding generation of paper dust and enabling image formation of high image quality.

9 Claims, 5 Drawing Sheets

IMAGE FORMING APPARATUS HAVING TRANSPORTATION GUIDE WITH FLUORINATED RESIN

BACKGROUND OF THE INVENTION

1. Field of the Invention

The present invention relates to an image forming apparatus such as a copying machine or a printer.

2. Related Background Art

Paper or sheet employed as the recording material in the conventional electrophotographic printer or copying machine has principally been so-called exclusive electrophotographic paper prepared with broad-leaf and/or needle-leaf pulp and certain additives such as caolin and rosin. Acidic paper was principally used for this purpose in the past, but neutral paper has recently been increasing in consideration of the storability and environmental issues.

For the neutral paper which has been recently used as the exclusive electrophotographic paper, calcium carbonate $CaCO_3$ is increasingly used as the additive in the North America and Europe. Such calcium carbonate includes heavy calcium carbonate which is prepared by crushing lime rock or is called chalk originated from ancient organisms, and light calcium carbonate which is prepared by crushing and heating lime rock to obtain CaO and blowing carbon dioxide gas into lime milk prepared by dissolving CaO in water. Such calcium carbonate, being inexpensive and providing excellent whiteness, is suitable for neutral paper and is often mixed, in the paper, up to 25% by weight.

On the other hand, the fixing unit of the printer or the copying machine may employ a pair of rollers as shown in FIGS. 5 and 6. In the fixing unit shown in FIG. 5, a fixing roller 60 and a pressure roller 61 are not given a bias voltage, and a felt member 63 containing silicone oil is maintained in contact therewith.

In the fixing unit shown in FIG. 6, a voltage of negative polarity is applied to the fixing roller, in order to prevent offsetting a toner 68 of negative polarity present on a recording material 67. Also to a pressure roller 61, a diode 65 is connected in order to further prevent the toner offsetting. In addition, the felt member for cleaning the fixing roller 60 is omitted in order to dispense with the trouble of replacement of the felt member. In these drawings, there are also shown a halogen lamp 62 and a lower entrance guide member 66.

However, the paper with a high content of calcium carbonate, when used in the printer or the copying machine utilizing the fixing unit as shown in FIG. 5 or 6, may result in the following drawbacks.

Powdered calcium carbonate is easily charged to positive polarity by friction with a metal or a plastic material. Thus, the calcium carbonate powder present in paper is easily charged to positive polarity by friction between papers when the paper is fed from the paper cassette, or by friction of the paper with a transport guide member or rollers in the transport path.

Also, when the paper is contained in the paper cassette and is fed therefrom, there is generated paper dust by the contact of paper with various rollers such as paper feed roller, transport roller, registration roller etc. or with guide members in the paper transport path, and such paper dust is deposited on the fixing roller. If paper rich in calcium carbonate content is used, calcium carbonate deposited on the fixing roller causes offsetting of the toner charged to negative polarity from the paper onto the fixing roller, since calcium carbonate is charged to positive polarity as described above. The offset toner adheres to the fixing roller, in mixed state with calcium carbonate thereon, and then is transferred onto the surface of the pressure roller of a temperature lower than that of the fixing roller, since calcium carbonate more easily sticks to the pressure roller of a lower temperature of 80° C. to 120° C. than to the fixing roller of a higher temperature of 180° C. to 200° C. Even if such transfer phenomenon takes place by a very small amount for each paper, there is generated a large black flake of toner on the surface of the pressure roller after passing of several tens of thousands of sheets. When such large flake of toner is developed, part of it sticks onto the fixing rollers, thus perturbing the toner image present on the recording material.

Tests with various papers have revealed that such phenomenon is frequently observed when the content of calcium carbonate in paper reaches 10 to 25% by weight.

In the conventional image forming apparatus, it is already known, as disclosed in the Japanese Patent Laid-Open Application No. 7-120993 (cf. FIG. 7), to provide a friction-reducing member such as a Teflon (trade name) adhesive tape and a coated layer of a similar material on the lower bottom face of the developing unit 70 opposed to a pre-transfer guide plate 69.

However such configuration is proposed to prevent "character skip (void)" in the image transfer to a rigid paper such as postcard, by reducing the contact frictional force between the upper face of the transported paper P and the lower face area of the bottom portion 70*a* of the developing unit 70, thereby preventing the loss of the transported speed of the paper P and maintaining the speed difference between the peripheral speed of the phototsensitive drum and the transported speed of the paper P at a level similar to that in case of ordinary paper. Consequently, the configuration of the image forming apparatus shown in the Japanese Patent Laid-open Application No. 7-120993 is unable to sufficiently suppress the generation of paper dust.

SUMMARY OF THE INVENTION

An object of the present invention is to provide an image forming apparatus capable of preventing deposition of paper dust on the rotary member for image formation an the recording material, thereby enabling satisfactory image formation over a prolonged period.

Another object of the present invention is to provide an image forming apparatus capable of suppressing generation of paper dust by suppressing the increase in the surface potential of fluorinated resin.

Still another object of the present invention is to provide a recording material for use in an image forming apparatus comprising a guide member for guiding the recording material and a rotary member for forming an image on the recording material guided by the guide member. Here, the guide member is composed of a conductive member, a guide face of which for guiding the recording material is coated with fluorinated resin.

Still another object of the present invention is to provide a recording material for use in an image forming apparatus comprising a guide member for guiding the recording material and a rotary member for forming an image on the recording material guided by the guide member. Here, the guide member is composed of a conductive member, a guide face of which for guiding the recording material is coated with fluorinated resin, and the time constant of attenuation of the surface potential of the guide member is smaller than 0.28.

Still other objects of the present invention, and the features thereof, will become fully apparent from the following description.

DETAILED DESCRIPTION OF THE PREFERRED EMBODIMENTS

Now, the present invention will be clarified in detail by preferred embodiments thereof, shown in the attached drawings.

First Embodiment

Figure 1:
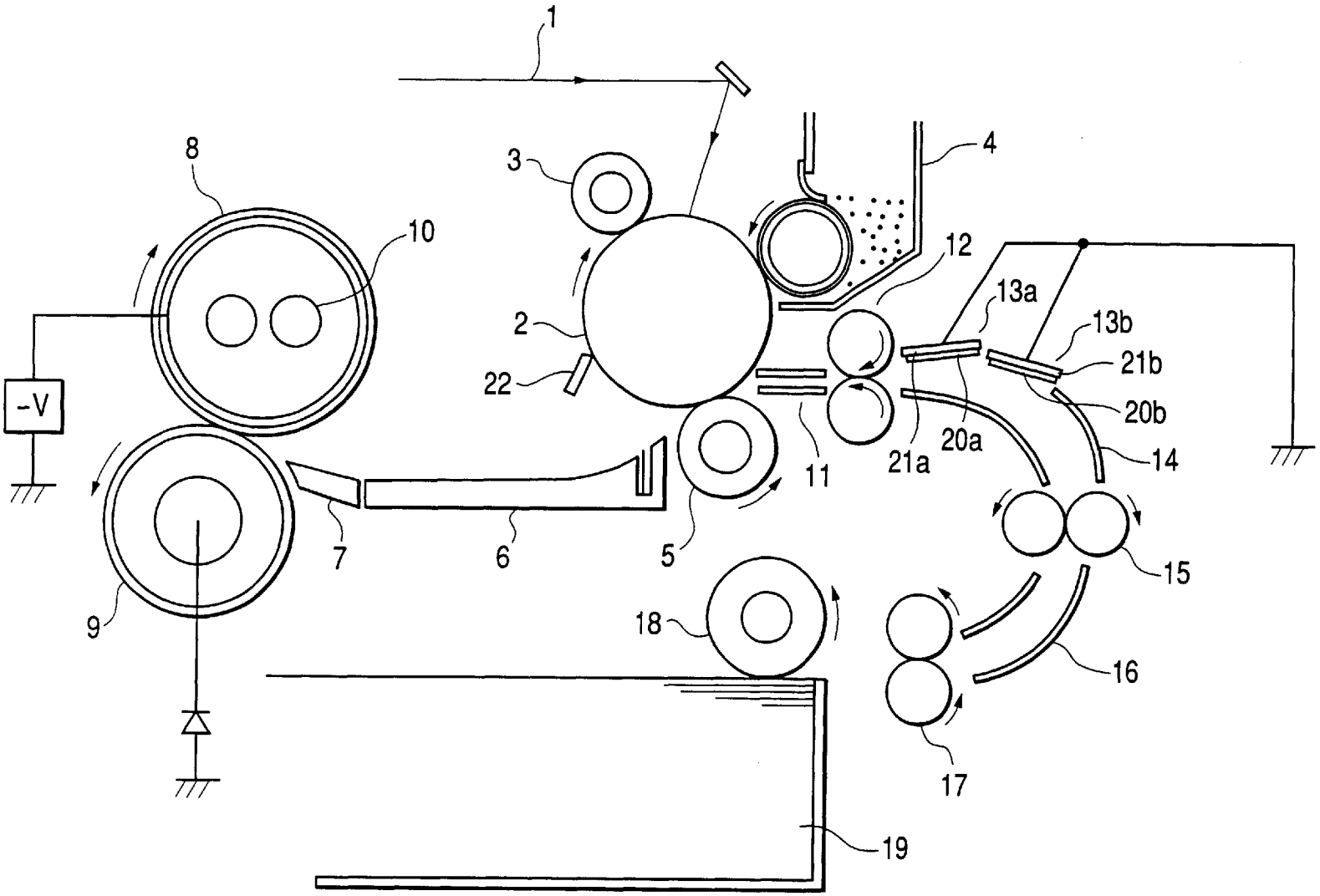
FIG. 1 is a schematic view of an image forming apparatus constituting a first embodiment of the present invention.

Referring to FIG. 1, a photosensitive drum (image bearing member) 2 is irradiated with a laser beam 1 corresponding to the image signal, by a laser unit (not shown) and a scanner unit provided with a polygon mirror. The photosensitive drum 2 is surfacially provided with an organic photosensitive member (OPC), and a charging roller 3 uniformly charges, the surface of the photosensitive drum 2 to negative polarity. The charging roller 3 itself is already known and will not be explained in detail. The laser beam 1 scans the surface of the photosensitive drum by so-called image scanning method in which the irradiation takes place in portions corresponding to the image.

An electrostatic latent image thus formed is then developed with a developing unit 4. The image development is achieved by jumping reversal development employing one-component magnetic toner, and by reversal development in which the toner of negative polarity is deposited to an area exposed to the laser beam 1.

Papers (recording material) are contained in a paper cassette 19, and are picked up one by one by a paper feeding roller 18 and are advanced by paired rollers 17.

The paper is then guided to a first guide member 16 pinched by paired intermediate rollers 15 and further advanced. Then the paper is vertically advanced by a second guide member 14, and the advancing direction of the paper is changed from vertical to horizontal by third guide members 13*a*, 13*b* (direction changing portion of the transport path) whereby the paper is guided to the nip between the paired registration rollers 12. The paper is introduced to the image transfer position by the paired registration rollers 12, so as to correspond to the image signal. Paired pre-transfer guide members 11 serve to introduce the paper exactly to the nip between a transfer roller 5 and the photosensitive drum 2. The transfer roller 5 is given a voltage of +1.5 to +5 kV, whereby the toner image charged to negative polarity, borne by the photosensitive drum 2, is transferred onto the paper. Subsequently, the paper is guided by a post-transfer guide member 6 and a pre-fixing guide member 7 and is introduced into the fixing unit. The toner remaining on the photosensitive drum 2 is removed by a cleaning member 22.

Figure 2:
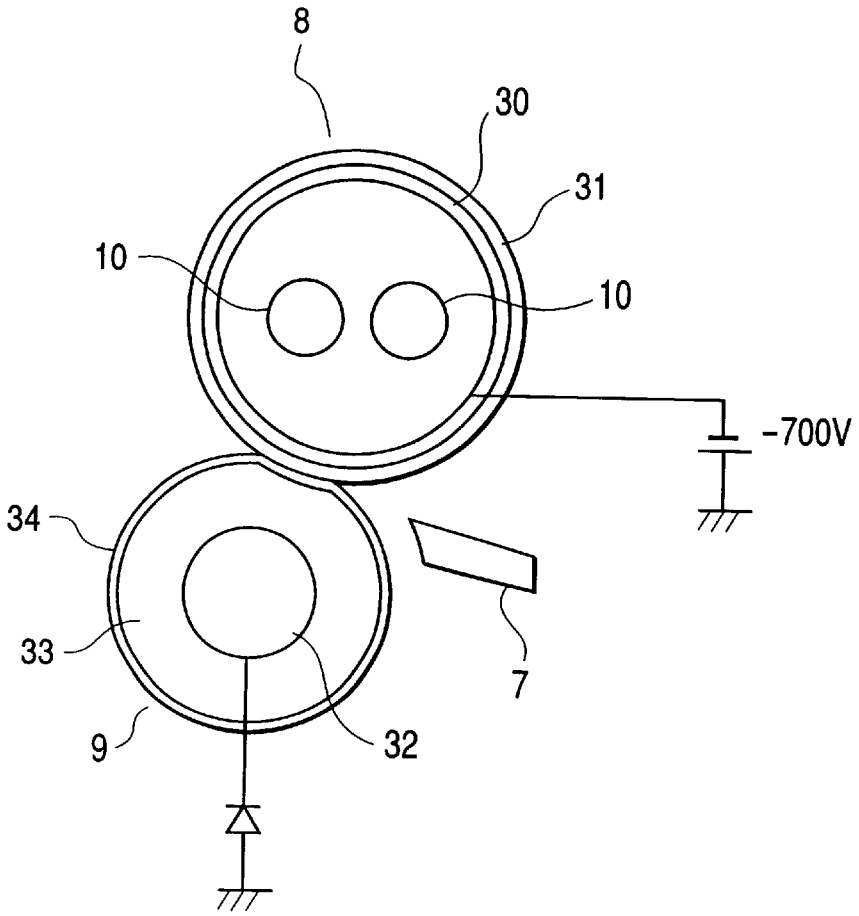
FIG. 2 is a view showing a fixing unit in the first embodiment of the present invention.

FIG. 2 shows the detailed configuration of the fixing unit.

The fixing unit transports the paper by a nip formed by a fixing roller 8 (first fixing rotary member) and a pressure roller 9 (second fixing rotary member) and heats the paper with a halogen lamp 10, thereby fixing the toner image to the surface of the paper.

The fixing roller is composed of an aluminum metal core 30 and a PFA tube 31 adhered thereon, and a voltage of −700 V is applied to the metal core 30. The PFA tube is electro-insulating and has a thickness of 50 $\mu$m. The pressure roller 9 is composed of a metal core 32, a conductive sponge layer 33 formed thereon and constituting a conductive elastic layer, and a conductive PFA tube 34 provided thereon. The metal core 32 is connected to a diode and is so self-biased that a voltage of positive polarity is generated.

The present invention is featured by a fact that a thin layer of fluorinated resin is formed in portions where the paper is in strong frictional contact with the constituent members of the transport path. If the portions of the transport path where the paper is in strong frictional contact with the paper are composed of fluorinated resin, the paper smoothly passes through the transport path without useless stress in the paper, whereby the generation of paper dust from the surface or end faces of the paper can be reduced.

In the present embodiment, fluorinated resin is provided on the surface of the third guide members (13*a*, 13*b*). The change in the advancing direction of the recording material is generally achieved by causing the end of the recording material to impinge on the constituent member of the transport path, with frictional contact therewith, thereby the recording material is in strong frictional contact with such constituent member in such direction changing portion. Therefore, the generation of paper dust can be suppressed by forming the direction changing portion of the transport path, coming into frictional contact with the recording material, with the fluorinated resin.

For example, in case the transport path from the paper cassette to the paired registration rollers 12 is U-shaped as shown in FIG. 1, the third guide members immediately in front of the paired registration rollers 12 come into strong frictional contact with the paper. As explained in the foregoing, the third guide members serve to change the direction of the front end of the recording material, vertically transported from the paired intermediate rollers 15, in the horizontal direction toward the nip between the registration rollers 12. As the front end of the paper is once stopped at the nip between the paired registration rollers 12, the paper forms an upward loop in a portion immediately in front of the registration rollers 12, thereby pressing the third guide members. Therefore the generation of paper dust can be further suppressed by forming fluorinated resin on the third guide members.

Further according to the present invention, the surface potential of the fluorinated resin film provided on the third guide members is maintained low for further suppressing the generation of paper dust, as explained in the following.

Figure 3:
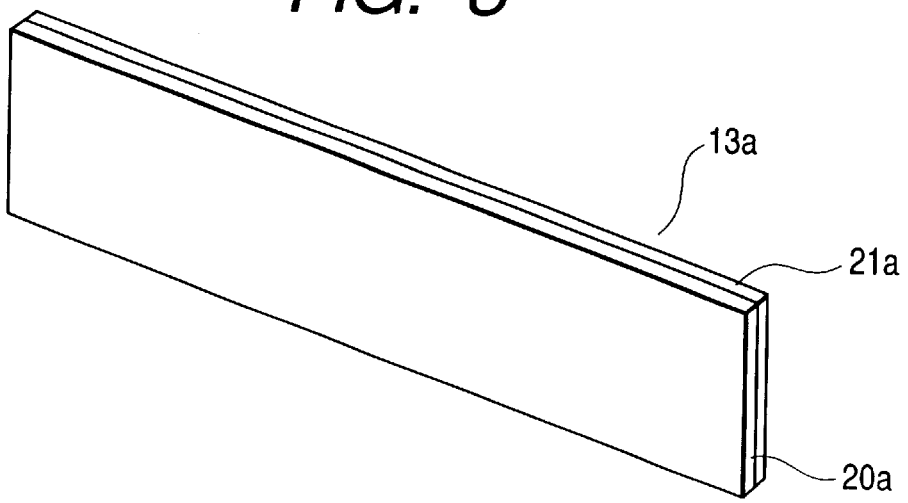
FIG. 3 is a view showing a guide member in the first embodiment of the present invention.

FIG. 3 shows the structure of one guide member 13*a*, among the third guide members in the present embodiment. The other guide member 13*b* is omitted as it is constructed similarly to FIG. 3.

A metal plate 21*a*, 21*b* of each of the third guide members is provided, on a surface guiding the paper, with a thin coated film 20*a*, 20*b* of fluorinated resin. The metal plate 21*a*, 21*b* is connected to the main body and is grounded. The fluorinated resin film may be formed by coating PTFE, PFA or PEA. The coating of the fluorinated resin is an already known technology and can be applied to the metal plate.

More specifically, the film of the fluorinated resin may be formed on the metal plate by coating and drying liquidous dispersion of fluorinated resin on the surface of the metal plate, then curing the entire members at a temperature of 200° C. to 350° C. In the heating step in such film-forming process, a large number of minute pinholes are generated in the coated film. Such pinholes allow to suppress the charging of the fluorinated resin. The surface of the fluorinated resin is negatively charged by friction with paper, but the charge on the surface of the coated layer easily escapes to the ground through the conductive member, by way of tin pinholes which are characteristic of the coated film, so that the charge scarcely remains on the film surface. Consequently the charged potential of the fluorinated resin can be maintained low.

On the other hand, calcium carbonate contained in the paper is charged to positive polarity, for example by contact with the transport guide member or the like as explained in the foregoing and is deposited onto the third guide members if the surface thereof is charged to negative polarity. Thus, deposited calcium carbonate is transferred from the third guide members to the paper by the frictional force therewith, and is eventually transported to the fixing unit.

However, according to the present invention, the generation of paper dust, principally composed of calcium carbonate, can be significantly reduced as the coated film of fluorinated resin is scarcely charged. It is therefore rendered possible to prevent smearing of the fixing roller or the pressure roller with calcium carbonate when the paper is transported to the fixing unit, thereby enabling formation of high quality image.

The coated film of a thickness of 50 to 150 $\mu$m has sufficient durability against friction with paper and can form appropriate pinholes. Such film is only charged to minus tens of volts from friction with paper, after passing 100 sheets of paper of a weight of 80 g/m$^2$ supplied by Rank Xerox Ltd.

For suppressing the frictional charge mentioned above, the coated layer is preferably composed of a single coated layer.

Comparative tests were conducted on the level of smearing of the fixing and pressure rollers, utilizing the third guide members constructed as shown in FIG. 3 and employing paper rich in calcium carbonate content. In a comparative example 1, the third guide members were composed of iron plates with conventional chemical nickel plating, and, in a comparative example 2, the third guide members were composed of metal plates surfacially covered with PET (polyethylene terephthalate). These three configuration were tested under the following conditions.

The employed paper had a calcium content of ca. 20% and a weight of 80 g/m$^2$. The printing operations were executed intermittently with such paper, and the number of sheets passed before generation of a predetermined smear on the surface of the pressure roller was compared as shown in the following table 1:

TABLE 1

| | Present Embodiment | Comparative Example 1 | Comparative Example 2 |
|---|---|---|---|
| Sheet Number | ca.200,000 | ca.50,000 | ca.50,000 |

As shown in the table 1, the present embodiment significantly increased the number of sheets before the generation of the smear in comparison with the reference examples 1 and 2, confirming the effect of the present embodiment. This effect is attributable, as explained in the foregoing, to a fact that the generation of paper dust, principally composed of calcium carbonate, is electrostatically suppressed.

On the other hand, in case the calcium carbonate-containing paper is passed over a fluorinated resin tape of a thickness of 150 $\mu$m adhered on a grounded metal plate, the surface of the fluorinated resin tape was charged negatively to several hundred volts and the generation of paper dust was larger in comparison with the case of employing the fluorinated resin coating but less in comparison with the reference examples 1 and 2.

In the foregoing description, the insulating member is solely composed of fluorinated resin, but it may also contain fillers such as mica or iron oxide. Also in addition to such insulating fillers, there may be added conductive fillers such as carbon. Such fillers increase the frictional resistance against paper, but are preferably added in an appropriate amount as they increase the friction.

Also, presence of conductive particles enhances the effect of attenuating the surfacial charge of the fluorinated resin, but such conductive particles are preferably added in an appropriate amount since they also increase the friction.

The attenuation curve of the surfacial charge of the fluorinated resin can be derived from an RC circuit and can be represented by:

$$I(t)=c\cdot e^{-t/a}$$

wherein I(t) is a value corresponding to the surfacial potential, t is time, c is a constant and a is a time constant.

A Teflon tape was adhered on the entire surface of a metal guide member, and the probe of a potential meter was positioned in facing relationship to the guide member to constantly measure the surfacial potential thereof. When papers were passed in succession, the surfacial potential of the Teflon tape was about −600 V. As it is already known that the charge is not dissipated from the Teflon tape, the potential at the charging (t=0) is estimated also as about −600 V.

On the other hand, the potential of a Teflon coating of a thickness of 50 $\mu$m, measured in the same manner, was about −10 V. The measured portion was in contact, from the front end to the middle portion thereof, with the paper, at about 0.5 seconds after the charging operation. Consequently, t=0.5 was employed in the calculation of the value a. Also, the constant c was assumed as 600 since the potential was assumed to be the same as that of the Teflon tape at t=0. These values were employed to determine the time constant a of the Teflon coating as a =0.12.

The generation of paper dust can be sufficiently reduced if the potential after attenuation is about −100 V. The time constant a corresponding to these values (c=600, t=0.5) is determined as a =0.28. Consequently, the third guide members needs to be constructed with such a material that the time constant a at attenuation becomes smaller than 0.28.

In case of employing the recording material containing calcium carbonate in the image forming apparatus utilizing the toner charged to negative polarity as the developer, the paper dust generated by friction for example with the metal members of the transport path is easily charged to positive polarity and is therefore deposited on the fixing roller etc., whereby the toner causes offsetting to deteriorate the image quality, but the present invention can prevent such deterioration of the image quality as the generation of paper dust is suppressed. As the recording material with a high content (for example 10 to 25%) of calcium carbonate generates a large amount of paper dust, the present invention is particularly effective in case of using such recording material.

The coating of fluorinated resin may be formed on the entire surface of the constituent members of the transport path or on a part thereof coming into contact with the recording material. Otherwise the coating of fluorinated resin may be formed on the entire surface of the transport path coming into contact with the recording material.

Also, in the fixing device in which a voltage is applied in such a direction as to press the developer toward the recording material as in the present embodiment, contaminant particles such as the paper dust principally composed of calcium carbonate charged in a polarity opposite to that of the developer tend to be adhered to the fixing rotary member by the voltage in the fixing device whereby the developer causes offsetting to deteriorate the image quality. However, according to the present invention, the generation of such contaminant particles can be suppressed so that the image formation of high image quality is rendered possible even in the image forming apparatus utilizing such fixing device.

Also, according to the present invention, as the deposition of contaminant particles onto the fixing device is reduced, the fixing device need not necessarily be equipped with the cleaning member whereby it is rendered possible to reduce the number of component parts and to reduce the burden of maintenance operation by the user.

Second Embodiment

Figure 4:
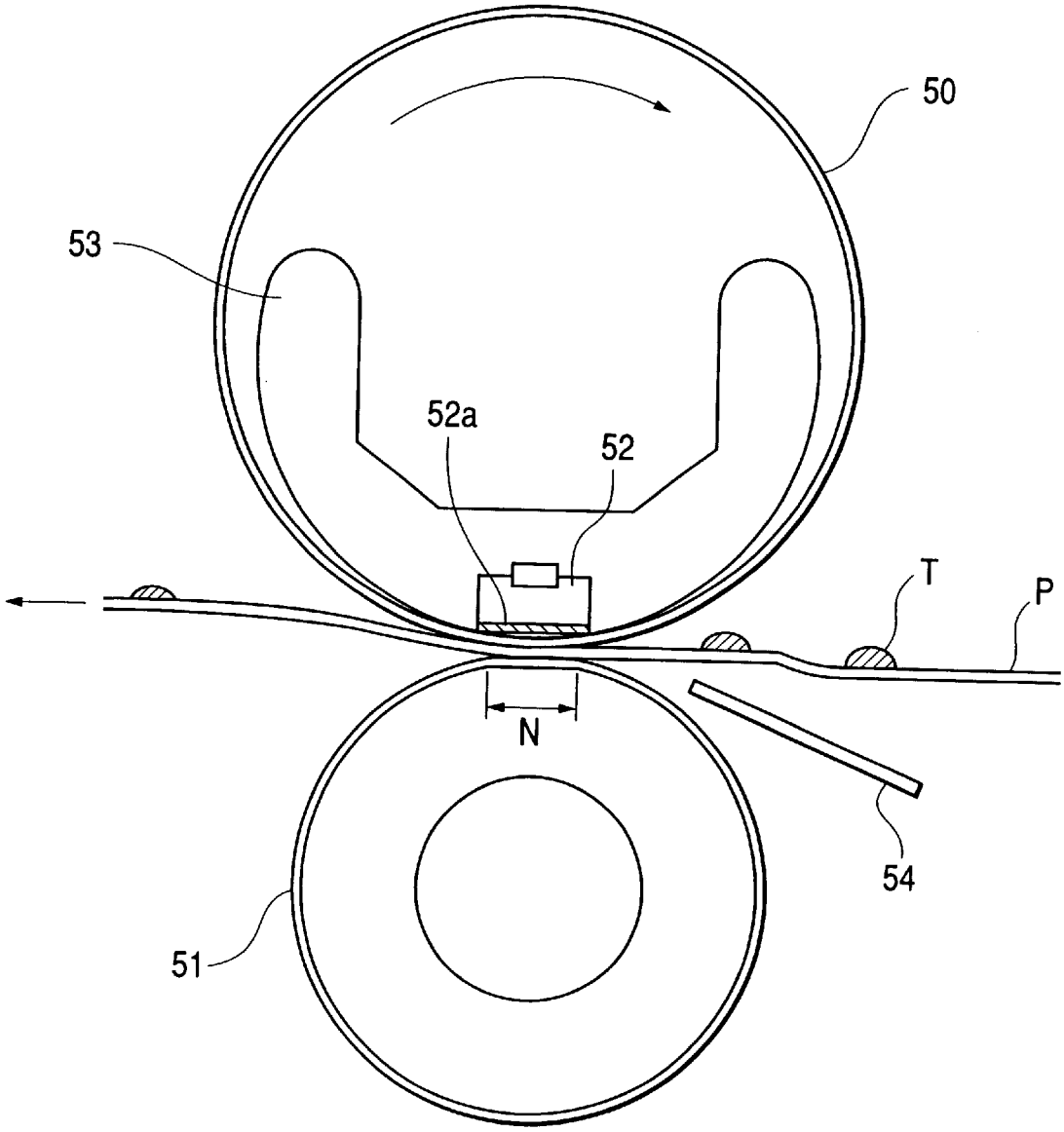
FIG. 4 is a view showing a fixing unit in a second embodiment of the present invention.
Figure 5:
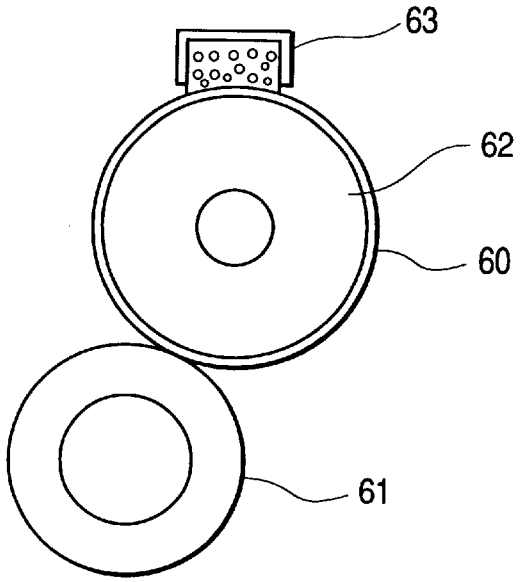
FIG. 5 is a view showing a conventional fixing unit.
Figure 6:
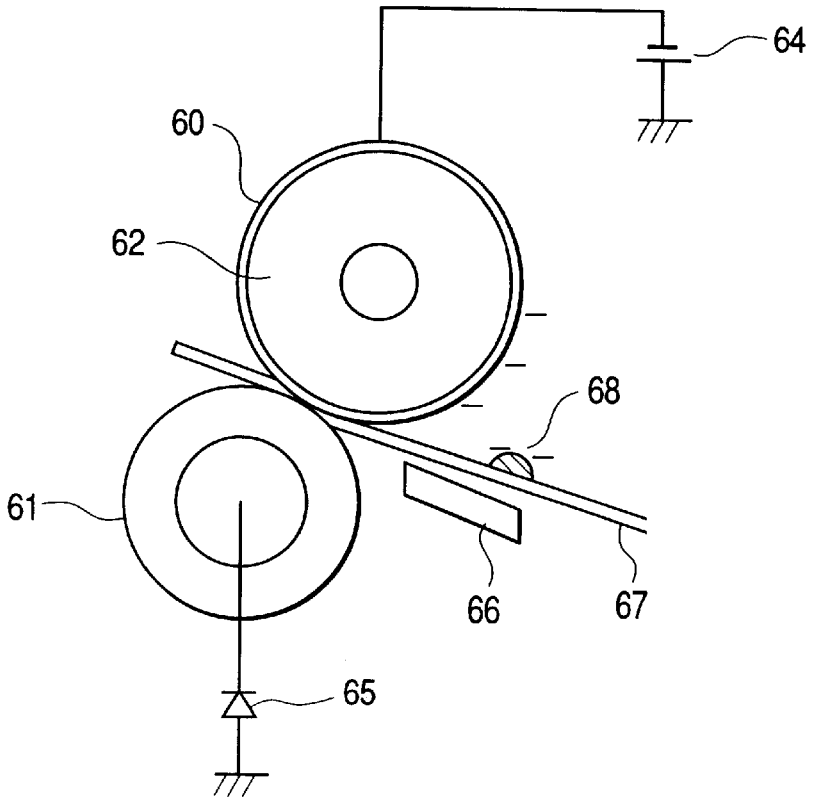
FIG. 6 is a view showing another conventional fixing unit.
Figure 7:
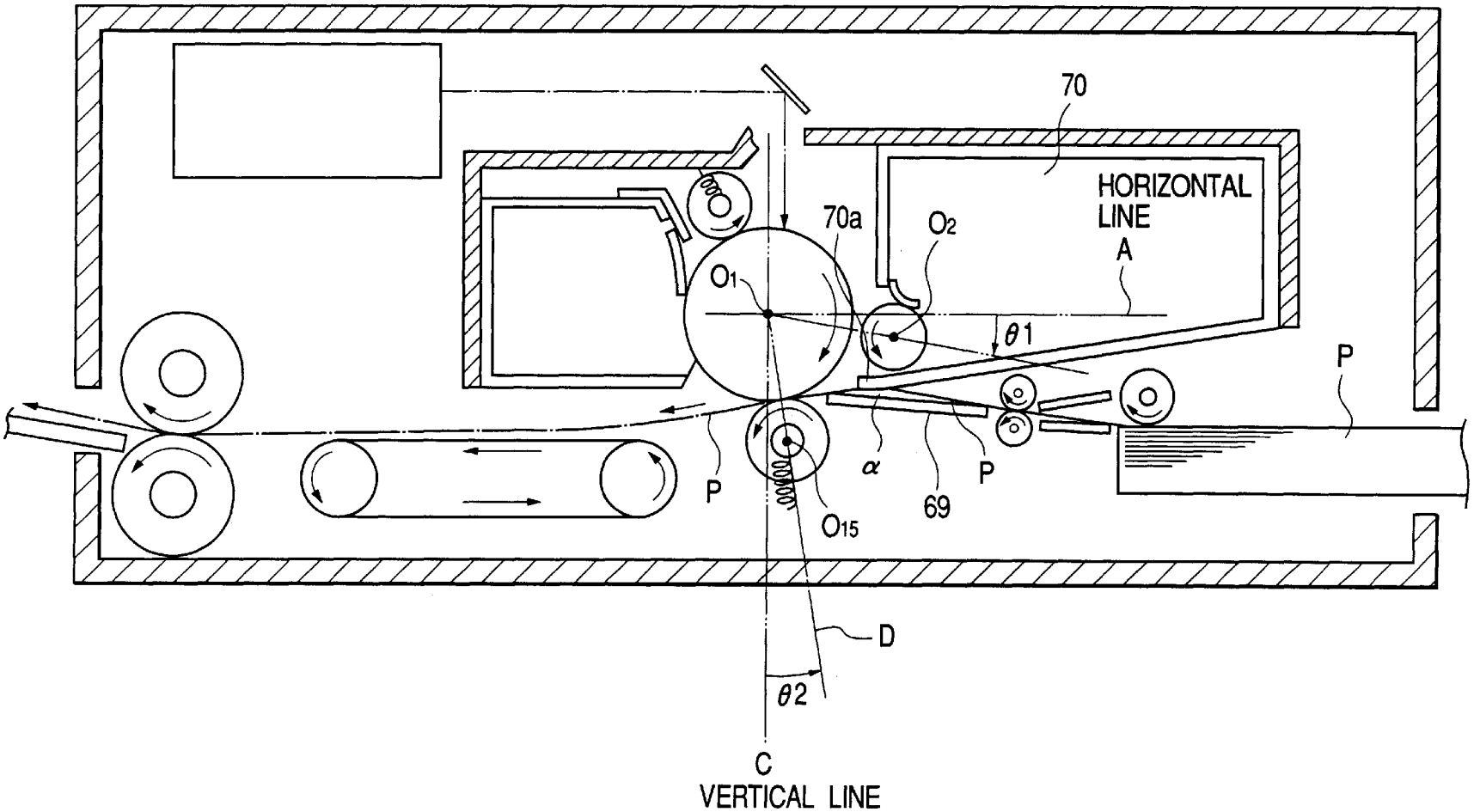
FIG. 7 is a view showing a conventional image forming apparatus.

FIG. 4 shows a fixing unit to be employed in an image forming apparatus such as a printer or a copying apparatus constituting the second embodiment of the present invention. Other parts of the image forming apparatus will not be explained as they can adopt the conventional configuration or those of the foregoing first embodiment.

Referring to FIG. 4, a heat-resistant film (fixing film) 50 formed as an endless belt covers, with a margin in the peripheral length, a semicircular film guide member (stay) 53. The film 50 has a thickness not exceeding 100 $\mu$m, preferably within a range of 20 to 60 $\mu$m in order to reduce the heat capacity and to improve the quick starting ability, and is composed of a single-layered film with heat resistance, releasing property, mechanical strength and durability such as of polyimide, polyamide, PEEK or PES or a composite layered film coated with PTFE, PFA or FEP as the releasing agent.

A pressure roller (pressurizing rotary member) 51 is composed of a metal core for example of iron or aluminum and an elastic layer of silicone rubber formed thereon. A guide member 54 is provided for smoothly introducing the recording material into the nip.

Referring to FIG. 4, the film 50 is driven, by the rotation of the pressure roller 51, with a predetermined peripheral speed in the clockwise direction, as indicated by an arrow, in contact with and sliding over a face of a heating member 52 at least in the execution of the image fixation. The predetermined peripheral speed mentioned above is approximately the same as the transport speed of the recording material bearing the unfixed toner image.

The heating member 52 is provided therein with a heat generating member (heat-generating resistance) 52*a* constituting a heat source which generates heat by current supply, and the temperature is elevated by heat generation of the heat generating member 52*a*. The heating member 52 is heated by electric power supply to the heat generating member 52*a*, and, while the film 50 is rotated, the recording material introduced into the nip N passes through the nip N in close contact with the film by the elastic force generated by deformation of the elastic layer of the pressure roller 51.

In such fixing unit, it is difficult to apply a bias voltage to the film 50 since it is positioned close to the heat generation member 52*a*. Also in such fixing unit, the cleaning pad is generally not used since it is structurally difficult to clean the surface of the film 50.

Smear on the rollers develops quickly when paper rich in calcium carbonate content is passed in such fixing unit, because the surfacial layer of the film 50 is often formed by coating and is therefore inferior to the tube-shaped member in the releasing property. Also the sharp-melting toner frequently employed in such fixing unit tends to generate smear on the roller more easily.

The roller smear was compared between the guide member C and other guide members by passing paper with a calcium carbonate content of ca. 20 wt. % in a laser beam printer employing the fixing unit shown in FIG. 4. The comparative examples 1, 2 are same as in the explanation of FIG. 1.

TABLE 2

| | Present Embodiment | Comparative Example 1 | Comparative Example 2 |
|---|---|---|---|
| Sheet Number to Roller Smear | ca.80,000 | ca.10,000 | ca.10,000 |

The table 2 shows the comparison of number of passed sheets until generation of predetermined smear on the roller. The formation of a thin fluorinated resin film by coating and curing in a portion of the paper transporting guide member coming into strong frictional contact with the toner bearing face of the paper allows to dissipate the charge on the fluorinated resin layer to the ground thereby preventing generation of paper dust principally consisting of calcium carbonate and avoiding smear on the roller.

The present invention has been explained by preferred embodiments thereof, but the present invention is by no means limited by such embodiments and is subject to any and all modifications within the scope and spirit of the appended claims.

What is claimed is:

1. An image forming apparatus comprising:

a guide member for guiding a recording material; and a rotary member for forming an image on the recording material guided by said guide member, wherein said guide member is composed of an electrically conductive member of which a guide surface for guiding the recording material is covered with a layer of fluorinated resin, and the time constant at attenuation of the surface potential of said guide member is smaller than 0.28, and wherein said guide member guides the recording material such that a transported direction thereof is changed from a vertical direction to a horizontal direction.

2. An image forming apparatus according to claim 1, wherein said conductive member is grounded.

3. An image forming apparatus according to claim 1, wherein said layer of fluorinated resin has a thickness not exceeding 150 $\mu$m.

4. An image forming apparatus according to claim 1, wherein said layer of fluorinated resin is formed by coating and curing fluorinated resin.

5. An image forming apparatus according to claim 4, wherein said layer of fluorinated resin is composed of a single layer.

6. An image forming apparatus according to claim 1, wherein said fluorinated resin contains a conductive filler.

7. An image forming apparatus according to claim 1, wherein said layer of fluorinated resin is formed by a fluorinated resin tape.

8. An image forming apparatus according to claim 1, wherein toner forming the image has negative charged polarity.

9. An image forming apparatus according to claim 1, wherein said recording material contains calcium carbonate.

* * * * *

UNITED STATES PATENT AND TRADEMARK OFFICE

CERTIFICATE OF CORRECTION

PATENT NO. : 6,259,885 B1
DATED : July 10, 2001
INVENTOR(S) : Masaharu Ohkubo et al.

It is certified that error appears in the above-identified patent and that said Letters Patent is hereby corrected as shown below:

Column 5
Line 10, "tin" should read -- tiny --.
Line 45, "configuration" should read -- configurations --.

Column 6,
Line 48, "needs" should read -- need --.

Signed and Sealed this

Twenty-sixth Day of February, 2002

*Attest:*

*Attesting Officer*

JAMES E. ROGAN
*Director of the United States Patent and Trademark Office*